US006152222A

United States Patent [19]

Kyllingstad

[11] Patent Number: 6,152,222

[45] Date of Patent: Nov. 28, 2000

[54] HYDRAULIC DEVICE TO BE CONNECTED IN A PIPE STRING

[75] Inventor: Åge Kyllingstad, Gjesdal, Norway

[73] Assignee: Kveilerorvibrator AS, Stavanger, Norway

[21] Appl. No.: 09/194,879

[22] PCT Filed: Jun. 6, 1997

[86] PCT No.: PCT/NO97/00146

§ 371 Date: Feb. 1, 1999

§ 102(e) Date: Feb. 1, 1999

[87] PCT Pub. No.: WO97/46787

PCT Pub. Date: Dec. 11, 1997

[30] Foreign Application Priority Data

Jun. 7, 1996 [NO] Norway ..... 962404

[51] Int. Cl.[7] ..... E21B 28/00

[52] U.S. Cl. ..... 166/177.6; 166/319; 175/56; 417/225

[58] Field of Search ..... 417/225, 392, 417/403; 166/177.6, 374, 383, 386, 319, 325; 175/1, 56

[56] References Cited

U.S. PATENT DOCUMENTS

| | | | |
|---|---|---|---|
| 3,235,014 | 2/1966 | Brooks . | |
| 4,384,625 | 5/1983 | Roper et al. . | |
| 5,411,107 | 5/1995 | Hailey et al. | 175/296 |
| 5,632,604 | 5/1997 | Poothodiyil | 417/225 |

FOREIGN PATENT DOCUMENTS

| | | |
|---|---|---|
| 151630 | 1/1985 | Norway . |
| 470408 | 2/1994 | Sweden . |

*Primary Examiner*—William Neuder
*Assistant Examiner*—Zakiya Walker
*Attorney, Agent, or Firm*—Wenderoth, Lind & Ponack, L.L.P.

[57] ABSTRACT

A vibration-generating device for a pipe string includes a hydraulic cylinder barrel, a hydraulic piston, changeover valves, and a double tubular piston rod. Each of the changeover valves is automatically shiftable. Fluid flows through the piston rod, changeover valves, and cylinder barrel.

16 Claims, 1 Drawing Sheet

CONTRACTION PHASE

SHIFTING : CONTRACTION - EXPANSION

CONTRACTION PHASE

SHIFTING : CONTRACTION - EXPANSION

EXPANSION PHASE

HYDRAULIC DEVICE TO BE CONNECTED IN A PIPE STRING

BACKGROUND OF THE INVENTION

The present invention relates to a hydraulically operated device adapted to be connected in a pipe string, specifically coiled tubing. For example, the device can be used in order to facilitate pushing of the string into highly deviated or horizontal wells in connection with working, and in maintenance operations such as logging, assembling or disassembling parts, acid and sand washing etc.

It has previously been proposed to provide drill strings with hydraulically operated devices or vibrators to facilitate the advance of the string. Thus, U.S. Pat. No. 4,384,625 proposes subjecting the drill string to vibrations in the form of resonance oscillations to reduce the friction between the drill string and bore hole wall in deviated wells to extend the reach in rotary drilling. As an example of a vibrator the patent refers to a fluid operated eccentric weight, implying substantially transversal vibrations.

U.S. Pat. No. 3,235,014 describes a method and apparatus for generating axial vibrations through a drilling swivel to transmit a percussive effect to the drill bit. Furthermore, various types of hydraulic hammer or percussion tools are known, which are intended for loosening sticking drill strings. An example of this type of tool is disclosed in NO patent 171 379.

Coiled tubing has substantially lower mass and diameter than drill pipes, which means that a transversally acting resonance vibrator with accompanying hydraulic motor as proposed in the above U.S. Pat. No. 4,384,625 would be rather ineffective when used in connection with coiled tubing. The main object of the invention, therefore, is to provide a device that effectively reduces friction, both at the coiled tubing head (lowermost tool section) as well as upwardly along the coiled tubing itself.

SUMMARY OF THE INVENTION

According to the invention, this object is achieved through a device as defined in the appendant claim 1. Advantageous embodiments of the invention are defined in the remaining appendant claims.

A device mounted to a coiled tubing through which pressurized fluid is flowing will continuously perform telescopic (axial) percussions or vibrations propagating along the entire lower part of the coiled tubing, including the coiled tubing head. The vibrations travel backwards along the coiled tubing. Due to the steady changes in the direction of transmission of the vibrations, the effective frictional resistance will be drastically reduced which will permit the coiled tubing to be pushed a substantial distance into a highly deviated and horizontal well bore before buckling and getting stuck. Calculations based on an 80° deviated well bore indicate an enhanced reach of as much as 3000 m.

The device according to the invention differs from prior vibrators intended for use in petroleum wells, primarily by the fact that it generates a telescopic (axial) vibration at a relatively high amplitude. Existing vibrators as discussed above are primarily designed to provide short and violent percussive pulses during drilling, or for releasing stuck tools. These hammer tools operate at a much lower vibration amplitude, implying vibrations of a substantially shorter operational range. Thus, they are of little use in enhancing the reach of coiled tubing.

Of course, although the primary object of the invention, as discussed above, is to provide a vibrator suitable for reducing the push frictional resistance of coiled tubing, there is nothing to prevent it from being used with advantage also in ordinary rotary drill strings. Furthermore, the purpose of the use of the device need not necessarily be to reduce friction. Thus, in some cases it may be advantageously used as a percussion tool, preferably mounted in front of the pipe string.

DETAILED DESCRIPTION OF THE INVENTION

Figure 2:
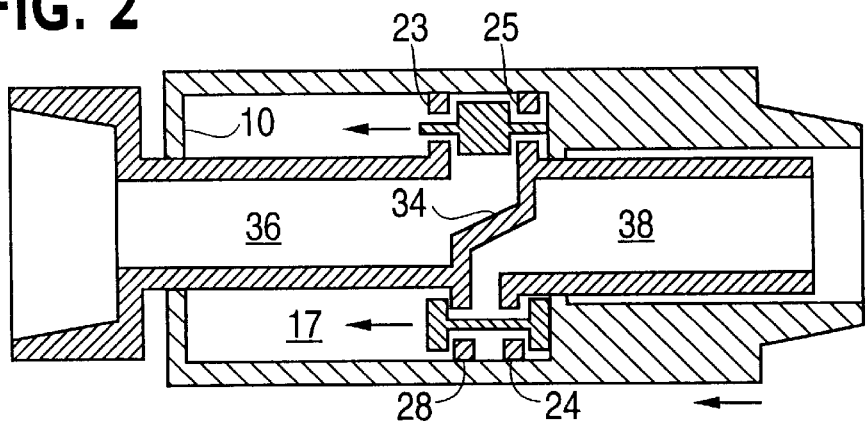
FIG. 2 is a schematic longitudinal cross sectional view of the device of the present invention in a second phase of operation.

The device according to the invention builds on per se well-known technology. Thus, in principle it is in the form of a double acting hydraulic cylinder having automatically operated changeover valves. As shown in the figures it comprises a hydraulic cylinder 1 including a cylinder barrel 4 and piston 6 having a tubular double piston rod 8 extending through the barrel end walls 10, 11 respectively. One end of the cylinder barrel has a tubular extension 12 receiving and preferably extending axially somewhat beyond the part of the piston rod 8 therein when the latter is in its outer end position (FIG. 2). The extension 12 terminates in a threaded portion 14 formed to mate with a corresponding threaded portion of a member of a pipe string such as coiled tubing. Similarly, the piston rod end protruding at the opposite end of the cylinder barrel also terminates in a threaded portion 16 adapted to mate with a pipe string member. In the drawings the threaded portion 14, 16 are shown as being tapered, but they may just as well be cylindrical, as is now most usual for coiled tubing. In the example shown the cylinder end portion 14 has external threads and the piston rod end portion 16 internal threads. However, the arrangement may of course be reversed if desirable. The cylinder 1, in its embodiment as shown, is designed to be mounted to the pipe string with its cylinder threaded portion 14 facing forward, i.e., in the direction of advancement of the pipe string. Consequently, in what follows, phrases such as forwards, backwards, foremost, rearmost, front, rear, refer to the direction of advancement of the pipe string (from left to right on the drawing).

The piston 6, which divides the cylinder barrel 4 into front and rear cylinder chambers or annulus 15 and 17 respectively, supports a plurality, in the shown example two, shuttle valves in the form of valve members 18 and 20. The valve members 18 and 20 are adapted to be axially displaced between a front port, 22 and 24 respectively, and a rear port, 26 and 28 respectively, formed in the piston faces 23, 25, and open into front annulus 15 and rear annulus 17, respectively. Shifting of the shuttle valves is automatically brought about by mechanical actuation whenever the piston reaches an end position. The two shuttle valves 18, 20 act as an inlet valve and outlet valve respectively, as explained in more detail below.

A lateral partition 34 divides the interior of the tubular piston rod into a rear part or inlet passage 36 and a front part or outlet passage 38 which, via an inlet opening 40 behind the partition and an outlet opening 42 in front of the partition, communicate with the inlet valve 18 and outlet valve 20, respectively.

In operation, with cylinder 1 mounted and oriented in a pipe string as described above, the device according to the invention will perform successive contraction and expansion phases, activated by fluid, such as drilling mud, pumped through the pipe string.

Figure 1:
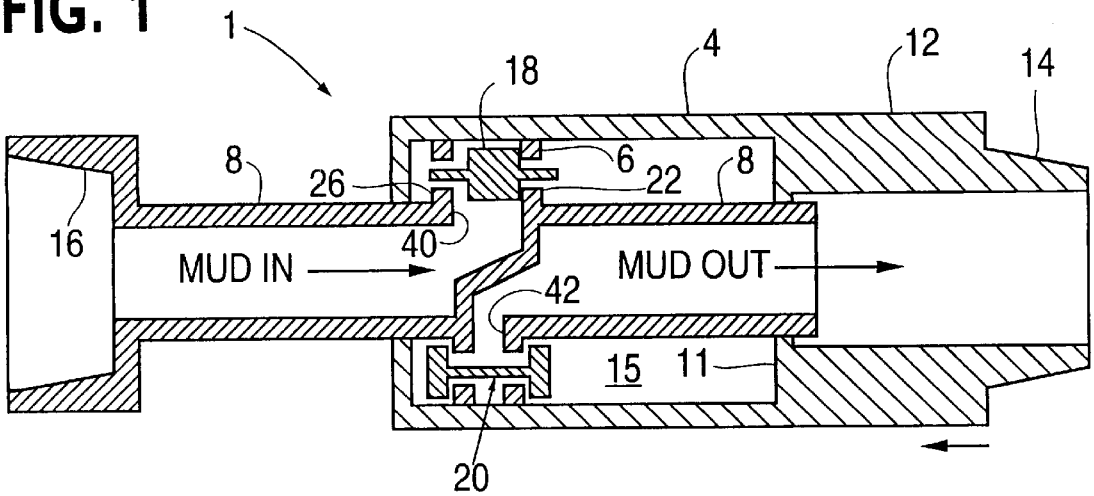
FIG. 1 is a schematic longitudinal cross sectional view of the device of the present invention in a first phase of operation.

In FIG. 1 the device is shown at the start of the contraction phase or stroke. Pressurized fluid flows into and through inlet passage 36, inlet opening 40, the open rear inlet port 26 and out into the rear cylinder annulus 17. The fluid pressure in the rear annulus urges the piston forward relative to the cylinder barrel, while the inlet and outlet valve members 18, 20, urged by the fluid pressure, close the front inlet port 22 and rear outlet port 28 respectively, to prevent fluid from flowing into the front cylinder annulus 15. Fluid in the front annulus flows through the open outlet port 24, through outlet opening 42, into piston rod outlet passage 38 and thence further to pipe string members downstream.

Figure 3:
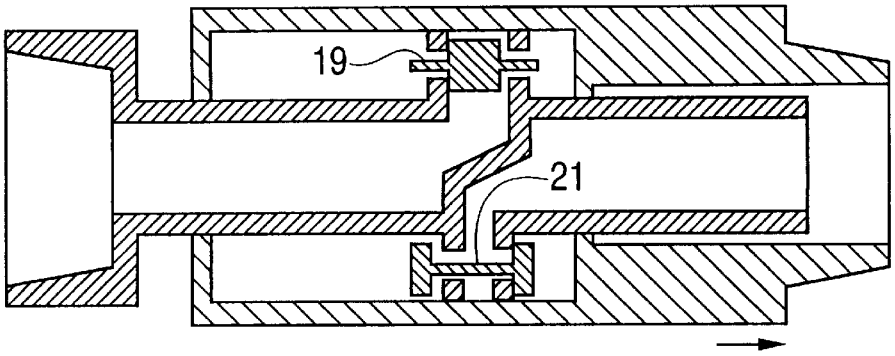
FIG. 3 is a schematic longitudinal cross sectional view of the device of the present invention in a third phase of operation.

FIG. 2 shows the cylinder at the end of the contraction phase, when the two shuttle valves 18, 20 automatically shift as they encounter the front end wall 11 pushing them backwards to open front inlet port 22 and rear outlet port 28. This causes the pressurized fluid to flow via port 22 into front annulus 15 to fill the latter, while the fluid in rear annulus 17 flows out through rear outlet port 28 and opening 42, outlet passage 38 and further through the pipe string. At this point the inlet and outlet valve members 18, 20 will be urged by the fluid pressure in the front annulus to close the rear inlet port and front outlet port respectively as shown in FIG. 3 to start the expansion phase in which the piston, urged by the fluid pressure in the front annulus, moves backwards relative to the cylinder barrel, until the valve members again shift as they encounter the rear end wall 10 of the cylinder barrel and a new contraction stroke starts as described above.

When the device is to act as a friction reducing vibrator in a coiled tubing, it is normally positioned in between the coiled tubing and tool string. In order to produce an optimal friction-reducing effect, the vibrations must have a certain amplitude (typical stroke: 10–50 mm) and a frequency high enough (typically 2–5 cycles per second) to permit the inertia of the tool string to force a considerable amount of the vibrations upwards along the coiled tubing. If a long stroke were to be chosen and a correspondingly low frequency, then the device would exhibit a functional mechanism different from that described above, since in that case the tool string would reciprocate. During the contraction phase, the tool string would serve as a frictional anchor, with the device pulling the string after itself.

The vibration frequency is determined by the cylinder volume, stroke and flow rate. On the other hand, with a given cylinder volume and stroke, the flow rate is determined by the fluid pressure and by the effective opening areas of the valves 18, 20. Although only two shuttle valves are shown in the schematic drawing, i.e., one inlet valve 18 and one outlet valve 20, in order to minimize the pressure loss across each valve, normally a plurality of valves, e.g., six valves, would be needed (i.e., three sets alternately distributed as inlet valves 18 and outlet valves 20). Furthermore it should be noted that although the piston partition 34 is schematically shown as a solid or unbroken inclined wall, if desirable it could be adapted to accommodate various valves. For example, pressure relief valves and/or flow control valves could be installed, closing when the flow rate exceeds a certain level.

As previously mentioned, the above described example of an embodiment of the vibrator device according to the invention is schematically illustrated in the drawing, since it builds on per se, well-known technical details which a person skilled in the art would be able to implement in a suitable manner without difficulty. Specifically, in practice the shuttle valves are conceivable in many forms.

However, in order not to leave any doubt as to the practical feasibility of the device, the example as shown in the drawing will now be described in a somewhat more detailed manner. Thus, in the drawing the inlet valve 18 is indicated as a cylindrical body slidably supported in inlet ports 22, 26 via two pins or shafts 19 (FIG. 3) axially protruding from either side of the valve member. In the schematic figures, which primarily are meant to illustrate the principle of the design and operation of the vibrator according to the invention, these shafts 19 are indicated as floating in ports 22, 26. In practice they would of course be sized to have a sliding fit diameter. Further, they would be formed in a manner to permit fluid to flow freely through an open inlet port. Thus, the shafts 19 could be in the form of perforated pipes, or a perforated bearing sleeve could be mounted in the ports. The distance between the outer ends of the shafts 19 is slightly larger than the distance between the faces of the piston 6, in order to cause shifting of the valve when the outer ends of the shaft encounter end walls 10, 11 of the cylinder barrel.

The outlet valve 20 is shown as a disk-like body at each end of an intermediate shaft 21 extending through outlet ports 24, 28 and acting as a support for the outlet valve body, in the same manner as described above in connection with the inlet valve member. The distance between the outer ends of the disks is substantially equal to that between the end surfaces of the inlet valve shafts, i.e., somewhat larger than the distance between the piston faces, in order to bring about shifting of the valve upon encountering the cylinder end walls 10, 11. The valve members 18, 20 could of course be spherical rather than disk-like. Furthermore, for optimal performance, some kind of spring means could be provided to accelerate the valve shifting and/or to hold the valve more steady at the end positions. It would not be necessary to explain these and other details of the valve structure in further details, since a person skilled in the art would realize what is needed to obtain a satisfactory valve performance.

As for the main dimensions of the cylinder barrel 4, its outer diameter would normally be equal to or less than the outer diameter of the pipe string to which it is connected, while the length of the cylinder barrel would depend on the desired stroke of the cylinder 1.

When using the vibrator device according to the invention in connection with coiled tubing operations, the device, as noted above, will normally be connected in between the coiled tubing and the tool string. However, as mentioned, the device according to the invention is also contemplated as a percussion tool mounted in front of the pipe string, and then possibly with a shape different from the front end threaded portion 14.

The cylinder 1 of the example as shown and described is adapted to be connected to the pipe string with its cylinder end portion 14 facing forward, which means that the fluid would flow in a direction from left to right in the figures. However, it could just as well be designed for a reversed connection, which means that the fluid would flow from right to left, since then the two shuttle valves 18, 20 are interchanged relative to the piston rod partition 34.

What is claimed is:

1. A vibration-generating device, comprising:

a hydraulic cylinder barrel;

a hydraulic piston arranged in said hydraulic cylinder barrel so as to form a front chamber and a rear chamber in said hydraulic cylinder barrel;

a plurality of changeover valves within said hydraulic cylinder barrel, each of said changeover valves being automatically shiftable; and a double tubular piston rod, wherein fluid flows through said double tubular piston rod, said changeover valves, said rear chamber, and said front chamber when said vibration-generating device is operational, wherein at least one end of said vibration-generating device has a threaded portion to be connected to a pipe string.

2. The device of claim 1, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

3. The device of claim 1, further comprising a lateral partition arranged within an interior of said double tubular piston rod so as to form a front portion and a rear portion in said interior of said double tubular piston rod, said changeover valves comprising a pair of shuttle valves disposed in said hydraulic piston at opposite sides of said lateral partition, each of said pair of shuttle valves communicating with a respective one of said front portion and said rear portion so as to form an inlet passage and an outlet passage for the fluid flowing into and out of said front chamber and said rear chamber of said hydraulic cylinder barrel.

4. The device of claim 1, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

5. The device of claim 3, wherein each of said shuttle valves is arranged within said hydraulic cylinder barrel so as to be mechanically shifted.

6. The device of claim 5, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

7. The device of claim 5, wherein each of said shuttle valves comprises a valve member having a pair a shafts extending in an axial direction therefrom, said hydraulic piston having a pair of end walls and having two ports formed in each of said end walls, each of said ports opening into one of said front chamber and said rear chamber, each of said shuttle valves being axially slidably supported between two of said ports by said shafts so as to shifted when contacting an end wall of said hydraulic cylinder barrel.

8. The device of claim 7, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

9. A vibration-generating device connected to a pipe string, comprising:

a pipe string; and a vibration-generating device including:

a hydraulic cylinder barrel;

a hydraulic piston arranged in said hydraulic cylinder barrel so as to form a front chamber and a rear chamber in said hydraulic cylinder barrel;

a plurality of changeover valves within said hydraulic cylinder barrel, each of said changeover valves being automatically shiftable; and a double tubular piston rod, wherein fluid flows through said double tubular piston rod, said changeover valves, said rear chamber, and said front chamber when said vibration-generating device is operational;

wherein at least one end of said vibration-generating device has a threaded portion connected to said pipe string.

10. The device of claim 9, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

11. The device of claim 9, further comprising a lateral partition arranged within an interior of said double tubular piston rod so as to form a front portion and a rear portion in said interior of said double tubular piston rod, said changeover valves comprising a pair of shuttle valves disposed in said hydraulic piston at opposite sides of said lateral partition, each of said pair of shuttle valves communicating with a respective one of said front portion and said rear portion so as to form an inlet passage and an outlet passage for the fluid flowing into and out of said front chamber and said rear chamber of said hydraulic cylinder barrel.

12. The device of claim 11, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

13. The device of claim 11, wherein each of said shuttle valves is arranged within said hydraulic cylinder barrel so as to be mechanically shifted.

14. The device of claim 13, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

15. The device of claim 13, wherein each of said shuttle valves comprises a valve member having a pair a shafts extending in an axial direction therefrom, said hydraulic piston having a pair of end walls and having two ports formed in each of said end walls, each of said ports opening into one of said front chamber and said rear chamber, each of said shuttle valves being axially slidably supported between two of said ports by said shafts so as to shifted when contacting an end wall of said hydraulic cylinder barrel.

16. The device of claim 15, wherein a stroke of said hydraulic piston between a first end wall of said hydraulic cylinder barrel and a second end wall of said hydraulic cylinder barrel is in a range of 10–50 mm, and wherein a cycle is defined as a reciprocal travel of said hydraulic piston from said first end wall to said second end wall and back to said first end wall, a stroke frequency being in a range of 2–5 cycles per second.

* * * * *